US008714970B2

(12) United States Patent
Dahlhielm et al.

(10) Patent No.: US 8,714,970 B2
(45) Date of Patent: May 6, 2014

(54) COMBUSTION CONTROL SYSTEM

(75) Inventors: Fredrick Stefan Jarl Dahlhielm, Lulea (SE); Kailash Nath Sriram, Northgate (AU)

(73) Assignee: Kailash & Stefan Pty Ltd, Brisbane QLD (AU)

( * ) Notice: Subject to any disclaimer, the term of this patent is extended or adjusted under 35 U.S.C. 154(b) by 48 days.

(21) Appl. No.: 13/497,117

(22) PCT Filed: Sep. 21, 2010

(86) PCT No.: PCT/AU2010/001236
§ 371 (c)(1),
(2), (4) Date: Jun. 6, 2012

(87) PCT Pub. No.: WO2011/032236
PCT Pub. Date: Mar. 24, 2011

(65) Prior Publication Data

US 2012/0270162 A1 Oct. 25, 2012

(30) Foreign Application Priority Data

Sep. 21, 2009 (AU) ..... 2009 904605

(51) Int. Cl.
*F23N 1/02* (2006.01)
*G06K 9/00* (2006.01)

(52) U.S. Cl.
USPC ..... 431/12; 382/109

(58) Field of Classification Search
USPC ..... 431/12, 68, 76, 7, 353, 354, 569, 285, 431/10, 269, 148, 168; 110/185, 186, 347, 110/190, 204, 304, 341; 356/335, 356, 417; 73/23.33; 382/109
See application file for complete search history.

(56) References Cited

U.S. PATENT DOCUMENTS 4,528,918 A * 7/1985 Sato et al. ..... 110/347
4,895,082 A * 1/1990 Mindermann et al. ..... 110/186
5,129,268 A * 7/1992 Uesugi et al. ..... 73/865.5
(Continued)

FOREIGN PATENT DOCUMENTS

CN 1587930 3/2005
CN 201081241 7/2008
(Continued)

OTHER PUBLICATIONS

Speight, J.G. "Handbook of Coal Analysis". John Wiley and Sons, 2007. (Chapter 7 is Attached).*

*Primary Examiner* — Avinash Savani
*Assistant Examiner* — Vivek Shirsat
(74) *Attorney, Agent, or Firm* — Hahn, Loeser & Parks LLP

(57) ABSTRACT

A combustion control system, including a first set of sensors for generating sample data including data representing a sequence of detected images of different samples of a fuel made up of solid particles; a fuel analysis module for controlling a processor of a computing device to: (i) determine attributes for one or more predetermined physical characteristics of the particles in each said sample based on the sample data, and (ii) generate an index value for each said sample based on said attributes, said index value representing a level of combustibility of the particles in each said sample; and a combustion control module for controlling a processor of a computing device to adjust one or more parameters for controlling a combustion process based on changes to said index value over time.

19 Claims, 2 Drawing Sheets

(56) References Cited

U.S. PATENT DOCUMENTS

| | | | | |
|---|---|---|---|---|
| 5,606,924 | A * | 3/1997 | Martin et al. | 110/341 |
| 5,890,444 | A * | 4/1999 | Martin et al. | 110/346 |
| 6,993,960 | B2 * | 2/2006 | Benson | 73/112.01 |
| 2004/0212675 | A1 * | 10/2004 | Lee | 348/83 |
| 2008/0081302 | A1 * | 4/2008 | Wintrich et al. | 431/12 |

FOREIGN PATENT DOCUMENTS

| | | | |
|---|---|---|---|
| DE | 10211410 | A1 * | 10/2003 |
| GB | 2249829 | A * | 11/1990 |
| JP | 08143919 | A * | 6/1996 |
| WO | 2006048495 | | 5/2006 |
| WO | 2009080094 | | 7/2009 |

* cited by examiner

COMBUSTION CONTROL SYSTEM

CROSS-REFERENCE TO RELATED APPLICATIONS

This application is a national stage of International Application No. PCT/AU2010/001236, filed Sep. 21, 2010, and claims priority to Australian Application No. 2009 904605 filed Sep. 21, 2009.

FIELD

The field relates to combustion monitoring and control systems, and related processes.

BACKGROUND

In any combustion reaction, it is desirable to ensure that the ratio of fuel to air is appropriate for achieving complete combustion of the fuel. Combustion in the presence of too much excess air tends to increase $NO_X$ production (and $CO_2$ if there is too much excess air and too little water), while combustion with insufficient air may result in CO production or result in unburnt fuel in the form of soot and/or slag.

A problem, however, is the difficulty in being able to accurately monitor and control a combustion process. For example, changes in fuel and air composition during combustion can occur rapidly. The typical method of controlling combustion is by measurements on the exhaust gases which are ineffective since there can be a significant time delay between the moment of combustion and the time at which a need for correction is detected. Another problem is that there is no reliable way of determining the amount of combustible material (or potential energy content) in a given amount of fuel. This is a significant problem in the combustion of solid fuels (such as pulverised coal), which may contain different amounts of impurities in different samples of fuel being fed to a burner. As a result, it can be very difficult to work out the volume of air required for achieving complete combustion of a sample of fuel.

There is also a growing need for technologies that help reduce greenhouse gas emissions, and to use fuels such as coal more efficiently and effectively in energy production. Attempts have been made to minimise the release of pollutants (such as CO, $CO_2$ and $NO_X$) by improving the cleaning of flue gases after combustion. Attempts have also been made to develop more thermally efficient systems that use less coal to generate the same amount of power (e.g. using higher grade coal), together with improved techniques for effluent treatment and residue use and/or disposal. However, none of these approaches address the problem of detecting and correcting imbalances in fuel/air composition to minimise the production of undesirable gases.

There have been other attempts at monitoring and controlling combustion. WO 88/02891 describes a video image processing method for flame monitoring in a combustion process. Video cameras capture images of the flame from the side. The video signal is continually processed to find an ignition area of the flame (based on the gradient of pixel intensities). Temporal changes in the location of the ignition area are used to control the boiler. However, this technique focuses on a specific characteristic of the flame, and does not control combustion based on any physical characteristics of the inputs (e.g. fuel) used for combustion.

Another approach is described in WO 96/34233, which relates to a method of measuring the amount of pulverised fuel in a boiler for controlling a combustion process. Furnace cameras measure the distribution of heat radiation emitted by the flame over a predefined area. An irradiance value is determined for a point within the flame area at a set distance away from the ignition point of the flame. The air feed rate to the burner is determined simultaneously. The fuel feed rate is determined based on the irradiance value and the air feed rate (which enables the amount of pulverised fuel in the flame to be determined). The air feed rate is adjusted according to changes in the fuel feed rate. This technique does not control combustion based on any physical characteristics of the inputs used for combustion.

It is therefore desired to address one or more of the above problems, or to at least provide a useful alternative to existing combustion control techniques.

SUMMARY

A combustion control system (and related process) is described. In general terms, the system performs image analysis to identify one or more physical attributes of solid fuel particles (e.g. pulverised coal) to determine a combustibility level of the fuel (representing its potential energy content). The combustion process is configured and controlled based on the combustibility of the fuel. The system may further involve performing analysis of various optical characteristics of products resulting from the combustion process, and making appropriate adjustments to configuration parameters for controlling the combustion process.

One described embodiment relates to a combustion control system, including:

- a first set of sensors for generating sample data including data representing a sequence of detected images of different samples of a fuel made up of solid particles;
- a fuel analysis module for controlling a processor of a computing device to: (i) determine attributes for one or more predetermined physical characteristics of the particles in each said sample based on the sample data, and (ii) generate an index value for each said sample based on said attributes, said index value representing an estimate of energy content in the particles in each said sample; and
- a combustion control module for controlling a processor of a computing device to adjust one or more parameters for controlling a combustion process based on changes to said index value over time.

A key advantage of the combustion control system is the ability to detect changes in the circumstances affecting a combustion process in close to real time (based on an analysis of the changes in the combustibility characteristics of the fuel used for combustion over time, as well as one or more optical characteristics representing an end result of the combustion over time). Other benefits and advantages can be appreciated from the following description.

The system may further include:

- a second set of sensors for generating combustion data including data representing a sequence of detected images from within a combustion chamber;
- a combustion analysis module for controlling a processor of a computing device to determine attributes for one or more predetermined characteristics of a product resulting from said combustion process based on said combustion data; and
- wherein said combustion control module being adapted to adjust one or more of said parameters based on changes to said index value over time and changes to said detected attributes for said predetermined characteristics over time.

BRIEF DESCRIPTION OF THE DRAWINGS

Representative embodiments of the present invention are herein described, by way of example only, with reference to the accompanying drawings, wherein.

DETAILED DESCRIPTION OF THE REPRESENTATIVE EMBODIMENTS

Figure 1:
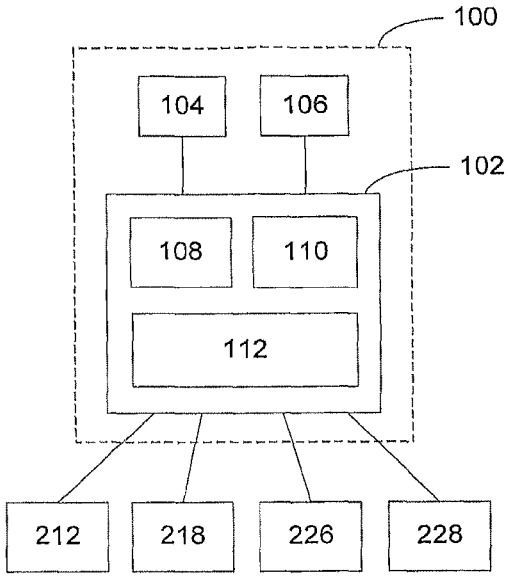
FIG. 1 is a diagram showing the main components of the combustion control system.
Figure 2:
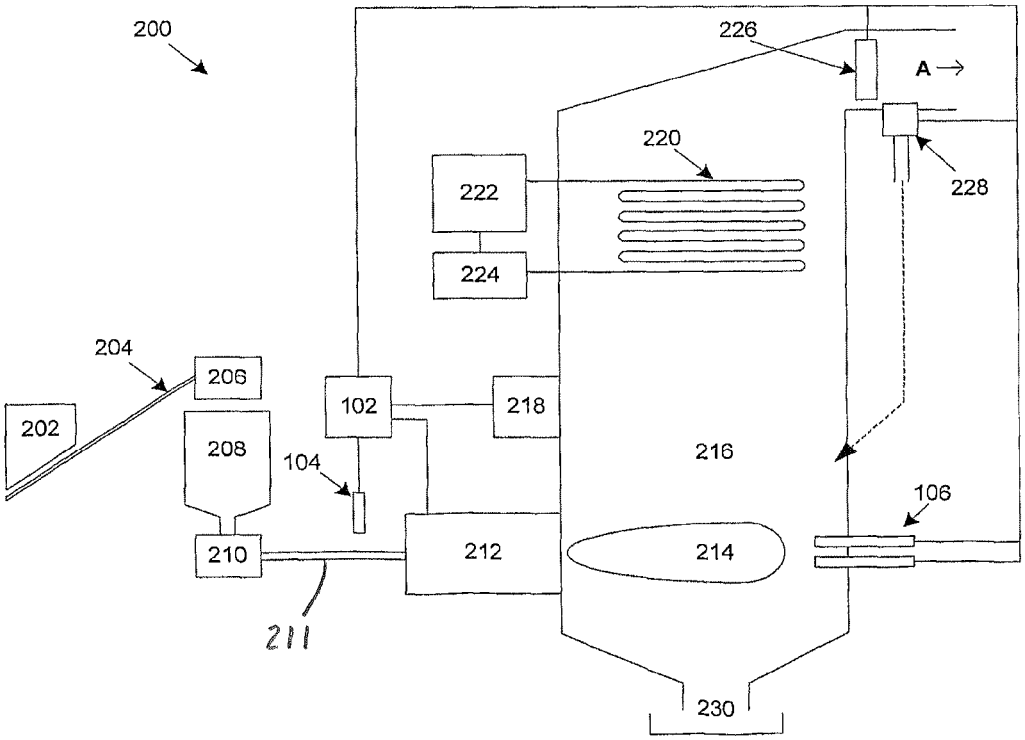
FIG. 2 is a diagram of the system configured for use in a coal-fired power plant.

A combustion control system 100, as shown in FIG. 1, includes a controller 102 that communicates with a first set of sensors 104 and a second set of sensors 106. The controller 102 includes a fuel analysis module 108, combustion analysis module 110 and a combustion control module 112. The analysis modules 108 and 110 process and analyse data received from the first and second sets of sensors 104 and 106. The combustion control module 112 of the controller 102 generates or adjusts one or more configuration parameters (based on the results of analysis from the analysis modules 108 and 110) for controlling the operation of different hardware components to modify factors affecting a combustion process. As shown in FIG. 2, the controller 102 generates or adjusts configuration parameters for a primary burner 212, secondary burner 218, exhaust fan 226, exhaust recirculation valve 228, and also for the first and second set of sensors 104 and 106.

The first and second set of sensors 104 and 106 are each made up of one or more different sensors, and each includes at least one image sensor adapted for capturing a sequence of optical images and generating image and/or video data representing the captured sequence of images. Each image sensor may include one or more of a solid-state matrix sensor, a charge-coupled device (CCD) sensor, and a complementary metal-oxide-semiconductor (CMOS) active pixel sensor. For example, an image sensor may be part of a video camera. The controller 102 may be a standard computer, a portable computing device (e.g. a laptop), or a specialised computing device for controlling a combustion process as described herein. The controller 102 includes a processor that operates under the control of commands or instructions generated by the fuel analysis module 108, combustion analysis module 110 and combustion control module 112. The term processor is used in this specification to refer to either a collection of one or more microprocessors, one or more hardware components of a device, or an entire device that is configured for performing the acts in the combustion control process 300 shown in FIG. 3.

The fuel analysis module 108, combustion analysis module 110 and combustion control module 112 may be provided by computer program code. Those skilled in the art will appreciate that the processes performed by the modules 108, 110 and 112 can also be executed at least in part by dedicated hardware circuits, e.g. Application Specific Integrated Circuits (ASICs) or Field-Programmable Gate Arrays (FPGAs).

FIG. 2 is a diagram of the combustion control system 100 configured for use with a typical coal-fired power plant 200. Coal is delivered into a hopper 202 and loaded onto a conveyor belt 204 to feed the coal into a crusher 206. Crushed coal is stored in a silo 208 and is passed through a pulveriser 210 when fuel is required by the power plant 200. The pulverised coal is delivered (e.g. using a second conveyor belt 211) to the primary burner 212, which delivers a mixture of primary air and pulverised coal into the combustion chamber 216 for combustion to produce a flame 214. A secondary burner 218 may supply further air and/or pulverised coal into the combustion chamber 216 to increase a level or rate of combustion. Slag that may be produced during combustion can be collected via the opening 230. Heat produced by the combustion heats up the water inside of tubes 220 fitting inside the combustion chamber, which produces steam to drive a turbine 222 (e.g. to produce electricity). The steam is then passed to a cooler 224, which recondenses the steam into water for supply back into the tubes 220. An exhaust fan 226 rotates to assist the extraction of exhaust gases from the combustion chamber 216. Exhaust gases generally move in direction A (shown in FIG. 2) to other structures of the power plant 200 that clean, filter and cool the gases before releasing the processed gas into the atmosphere. However, an exhaust gas recirculation valve 228 may be activated to divert a flow of hot exhaust gases back into parts of the combustion chamber 216.

In the representative embodiment shown in FIG. 2, the first set of sensors 104 are positioned within visible range of the pulverised coal (or other fuel made up of solid particles) being provided to the primary burner 212. As the pulverised coal moves past the first set of sensors 104, images of different samples of the pulverised coal are captured for processing and analysis by the fuel analysis module 108. The image capturing process is repeated continuously, or at regular time intervals. As a result, the first set of sensors 104 generates sample data including data representing a sequence of detected images of different samples of the pulverised coal. The sample data may include video data (or signals) representing the captured images, or image data (or signals) representing different individual images captured at different points in time.

The fuel analysis module 108 controls a processor of the controller 102 to perform pre-processing of the sample data to enhance and clarify the represented images. Pre-processing may involve applying one or more of the following enhancement techniques to the data in an image (or video frame): scaling, resizing, image/frame correction or enhancement, colour correction or enhancement, edge detection, grey level stretch, noise elimination, erosion/dilation, thinning, split and merge, merge small regions, background split, merge and split on shape, polygonal approximation, classification of concavities, split large clusters into simple clusters, supplementary cost functions for two or three touching particles, image binarisation, skeleton, distance function, split based on skeleton histogram. The fuel analysis module 108 then controls a processor of the controller 102 to analyse the sample data.

Coal is non-homogenous, and typically contains a combination of carbon particles and other elements (or impurities) bonded together. The carbon content of coal indicates the amount of potential energy that can be released by the coal during combustion. An advantage of burning coal with higher energy content is that less $CO_2$ will be produced. However, another way to enhance combustibility is to pulverise the coal into fine particles for combustion. The particles of pulverised coal may relate to different chemical elements, each of which may have different combustibility characteristics, and each of which can be detected based on their individual physical characteristic including colour, intensity, texture, size, shape, weight and density.

For each image (or frame) represented by the sample data, the fuel analysis module 108 identifies individual particles of pulverised coal (for at least some of the particles detected within the image of the sample). The fuel analysis module 108 then analyses each particle to determine attributes for one or more predefined physical characteristics (such as colour, intensity, texture, size, shape, weight and density). This analysis enables the fuel analysis module 108 to identify the main types of elements comprised in the sample of coal, and based on the combustibility characteristics of these elements, the fuel analysis module 108 generates an index value for each sample representing an estimated energy content within each sample of coal (e.g. based on the amount and combustibility of the material in each sample).

The following description outlines how the combustibility index value may change depending on the attributes for key predefined physical characteristics of fuel particles in a sample:

Particle size: Smaller sized particles are more likely to react quickly in combustion. Very fine particles are likely to comprise clay or impurities (rather than carbon particles), which are likely to produce slag in combustion. The fuel analysis module 108 may generate the index value based on a size distribution of the particles within a sample (e.g. placing greater weight on smaller sized particles, but lesser weight on the very fine particles at the extreme of the overall distribution).

Particle shape: This factor relates to the extent of a particle's surface exposure to air for combustion. Edgy particles (e.g. particles that are long and thin in shape) have a higher concentration of surface energy around the edges, and a lower concentration of surface energy along the sides. Such particles are eager to react, and thus burn faster. Particles that are spherical in shape have a lower and more even surface energy, and thus burn in a more controlled and consistent manner. The fuel analysis module 108 may generate the index value based on a distribution of shapes of particles within a sample (e.g. placing greater weight on the presence of particles with a generally spherical shape). In another representative embodiment, the fuel analysis module 108 may analyse the overall distribution of particle shape within the sample and generate commands, signals, instructions or parameters for controlling a grinding process (e.g. for pulverisation) to produce particles of a shape suited to the combustion characteristics of a specific burner.

Colour: Carbon particles are characterised by having a dark surface colour. In contrast, minerals (which have lower combustibility in comparison to carbon particles) generally have a lighter surface colour. The fuel analysis module 108 may generate the index value based on a distribution of colours reflected by the particles in a sample (e.g. placing greater weight on the proportion of particles reflecting a colour that is consistent with a colour profile for carbon particles, and placing lesser weight on the proportion of particles reflecting a colour that is (i) not consistent with a colour profile for carbon particles, or (ii) consistent with a colour profile of other elements of lower combustibility). In a representative embodiment, the difference between carbon particles and other elements is detected based on a grey scale (or black and white) representation of an image of a sample. The colour values for a particle may be compared with a mean grey scale value calculated for an entire image (or frame) to determine whether the particle is dark in colour (i.e. characteristic of carbon particles) or light in colour (i.e. characteristic of other elements). Alternatively, the fuel analysis module 108 may detect the presence of certain particles based on the reflective characteristics of those particles under natural or artificial light. For example, natural or artificial light of a particular wavelength is shone over the particles when the image is captured, where the reflectance of one or more specific wavelengths of light is indicative of the presence or absence of a particular type of particle (e.g. carbon).

Intensity: This is similar to colour, but relates to the intensity of a particular wavelength of light being reflected by certain types of elements in the coal.

Weight: The first set of sensors 104 may include a weight sensor for detecting a weight of at least some of the particles in the sample corresponding to the captured image. The fuel analysis module 108 may adjust the index value based on the detected weight and the relative volume or density of the particles in the sample. For example, a significant increase in weight (with a corresponding increase in particle volume or density) may indicate the presence of more fuel, which may trigger the fuel analysis module 108 to increase the index value. Conversely, a significant decrease in weight (with a corresponding decrease in particle volume or density) may indicate the presence of less fuel, which may trigger the fuel analysis module 108 to decrease the index value. A significant increase in weight (with no significant increase in the volume or density of the particles in a sample) may indicate the presence of rocks or other heavy materials with low combustibility, which may trigger the fuel analysis module 108 to decrease the index value. Further, a significant decrease in weight (with little or no decrease in the estimated volume or density of the particles in a sample) may indicate the presence of air being trapped between the particles, which may trigger the fuel analysis module 108 to decrease the index value due to the presence of less fuel for combustion.

Density: This may be used in weight analysis as described above. A density of fuel particles can be determined using two separate image sensors (both being part of the first set of sensors 104) to capture images from two different angles of a sample (e.g. from the top and side). Monte Carlo distribution analysis can be used to predict a density of the fuel, which may not be directly observable by image sensors.

Texture: This relates to the roughness and formation of the surface of the particles, which may either have a positive or negative impact on the particle's combustibility.

The index values generated by the fuel analysis module 108 for each sample may be stored in one or more memory components, which may be part of the controller 112. The combustion control module 112 accesses index values for a sequence of samples, and detects and analyses changes in the index value (for different samples) over time. The combustion control module 112 generates or adjusts one or more configuration parameters (based on the index value changes) for controlling a combustion process. In a representative embodiment, this involves adjusting configuration parameters responsible for controlling one or more of the following:

fuel feeding rate—e.g. by adjusting the fuel feeding rate of primary and secondary burners 212 and 218;

excess air—e.g. by adjusting a primary and/or secondary air feeding rate for primary and secondary burners 212 and 218; and temperature—e.g. by adjusting a rotational speed of an exhaust fan 226 to change the rate of extracting hot exhaust gases from the combustion chamber, and/or a level of hot exhaust gas recirculation within the combustion chamber by adjustment of a valve 228.

In a representative embodiment, the configuration parameters are adjusted to increase or decrease a current rate of combustion to a level more appropriate for the combustibility of the fuel at the time. For example, the current rate of combustion may be adjusted so that it is appropriate for achieving complete combustion with the current sample of fuel (to minimise over production of products from combustion such as CO, $CO_2$, $NO_X$, $SO_X$, soot and/or slag).

One advantage of the combustion control system 100 is that the analysis carried out by fuel analysis module 108 can provide almost real time feedback on changes in the combustibility characteristics of a sample of fuel. In contrast, current industry practice is to take fuel samples to a laboratory for analysis on a weekly/monthly basis to assess the combustibility of the fuel, and make relevant adjustments to the configuration parameters based on the analysis results.

Another advantageous aspect of the combustion control system 100 is the ability to visually detect the changing dynamics of combustion and making changes to relevant configuration parameters based on the detected changes, and the index value (as described above), over time.

In the representative embodiment shown in FIG. 2, the second set of sensors 106 are positioned within visible range of a monitoring area inside the combustion chamber 216, including the flame 214. The second set of sensors 106 may be mounted on a retractable rig that enables the sensors 106 to be partially inserted into the combustion chamber 216, but having heat detection means (e.g. a heat sensor) that triggers the actuating means of the rig to retract the sensors 106 out of the combustion chamber 216 in the event that the temperature inside the chamber 216 reaches a predetermined temperature threshold that is hazardous to the sensors 106. The second set of sensors 206 captures images of the combustion inside the combustion chamber 216 (within the monitoring area) either continuously or at regular time intervals. As a result, the second set of sensors 106 generates combustion data including data representing a sequence of detected images containing visual characteristics of the combustion process at different points in time. The combustion data may include video data (or signals) representing the captured images, or image data (or signals) representing different individual images captured at different points in time.

In the same way as the fuel analysis module 108, the combustion analysis module 110 also controls a processor of the controller 102 to perform pre-processing of the combustion data to enhance and clarify the represented images. The combustion analysis module 110 then controls a processor of the controller 102 to analyse the combustion data. For each image (or frame) represented by the combustion data, the combustion analysis module 110 determines attributes for one or more predefined visual characteristics of a product resulting from the combustion process. The reference to a product includes a reference to the flame, temperature and gases that are produced as a result of the combustion process. The combustion analysis module 110 analyses one or more of the following optical characteristics of the flame (and other control factors including the amount of air, amount of fuel, combustibility of the fuel, and temperature of the combustion). Based on the changes to any of these optical characteristics over time (and together with the changes in the index value over time), the combustion control module 112 determines the need for and level of adjustment to any of the control factors:

flame shape: The combustion analysis module 110 detects a general shape of the flame based on a colour (or intensity) contrast between a bright portion corresponding to the flame and a relatively darker portion corresponding to the background. The combustion analysis module 110 also detects certain features within the bright portion of the flame. An ideal flame should be smaller close to the burner and become larger as the flame extends further away from the burner. An ideal flame should also have an even brightness where, for example, the presence of dark spots in a flame indicates a lack of fuel or air to sustain combustion in those areas. An ideal flame should also be relatively stable (i.e. with no significant flickering, which may indicate a lack of fuel, air or incomplete combustion of the fuel).

flame size: Once the boundary of the flame has been determined (e.g. based on the flame shape analysis as described above) the combustion analysis module 110 analyses the overall size of the flame relative to an expected size of the flame based on the amount of air, amount of fuel and combustibility of the fuel provided to the burner.

flame position: A flame positioned close to the burner, may indicate that the primary air feeding rate is too high. Conversely, a flame that is flickering or drooping down may indicate that the primary air feeding rate is too low.

colour and intensities of light produced by the flame: An ideal flame should produce a bright and even glow, with relative little dark spots (as described above).

The combustion analysis module 110 also analyses optical characteristics of temperature variations (or temperature gradients) inside the combustion chamber resulting from the combustion process. For example, in a representative embodiment, at least one of the second set of sensors 106 is adapted with an optical filter to enable visibility of a distribution of heat radiation (i.e. including the infrared spectrum) inside the combustion chamber 216. Another sensor 106 is adapted with a different optical filter to enable visibility of at least one of smoke particles, hot air currents, and slag being formed inside the combustion chamber 216. Based on the changes to any of these optical characteristics over time (and together with the changes in the index value over time), the combustion control module 112 determines the need for and level of adjustment to any of the control factors.

The combustion analysis module 110 also analyses optical characteristics of an exhaust gas produced as a result of the combustion process. For example, in a representative embodiment, the second set of sensors 106 includes different image sensors that are each adapted with a different optical filter for detecting the presence and/or intensity of one or more specific wavelengths in the combustion chamber 216 which represents the presence or absence of a particular type of exhaust gas (e.g. including CO, $CO_2$, $NO_X$ and $SO_X$). This is based on the understanding that different molecules comprised in the exhaust gases produced in combustion can either enhance or retard the reflection of certain wavelengths of light, which can serve as a optical signature that can be detected by an image sensor. Based on the changes to any of these optical characteristics over time (and together with the changes in the index value over time), the combustion control module 112 determines the need for and level of adjustment to any of the control factors.

For example, detecting the presence of $NO_X$ or CO in the combustion chamber 216 may indicate there is insufficient air in the combustion chamber, which may trigger the combustion control module 112 to increase a primary or secondary air feeding rate into the combustion chamber 216. Also, detecting the presence of an excessive amount of $CO_2$ in the combustion chamber 216 (relative to the amount of $CO_2$ expected from complete combustion of the fuel of known combustibility) may indicate that there is too much air and too little water, which may trigger the combustion control module 112 to decrease a primary or secondary air feed rate into the combustion chamber 216.

Figure 3:
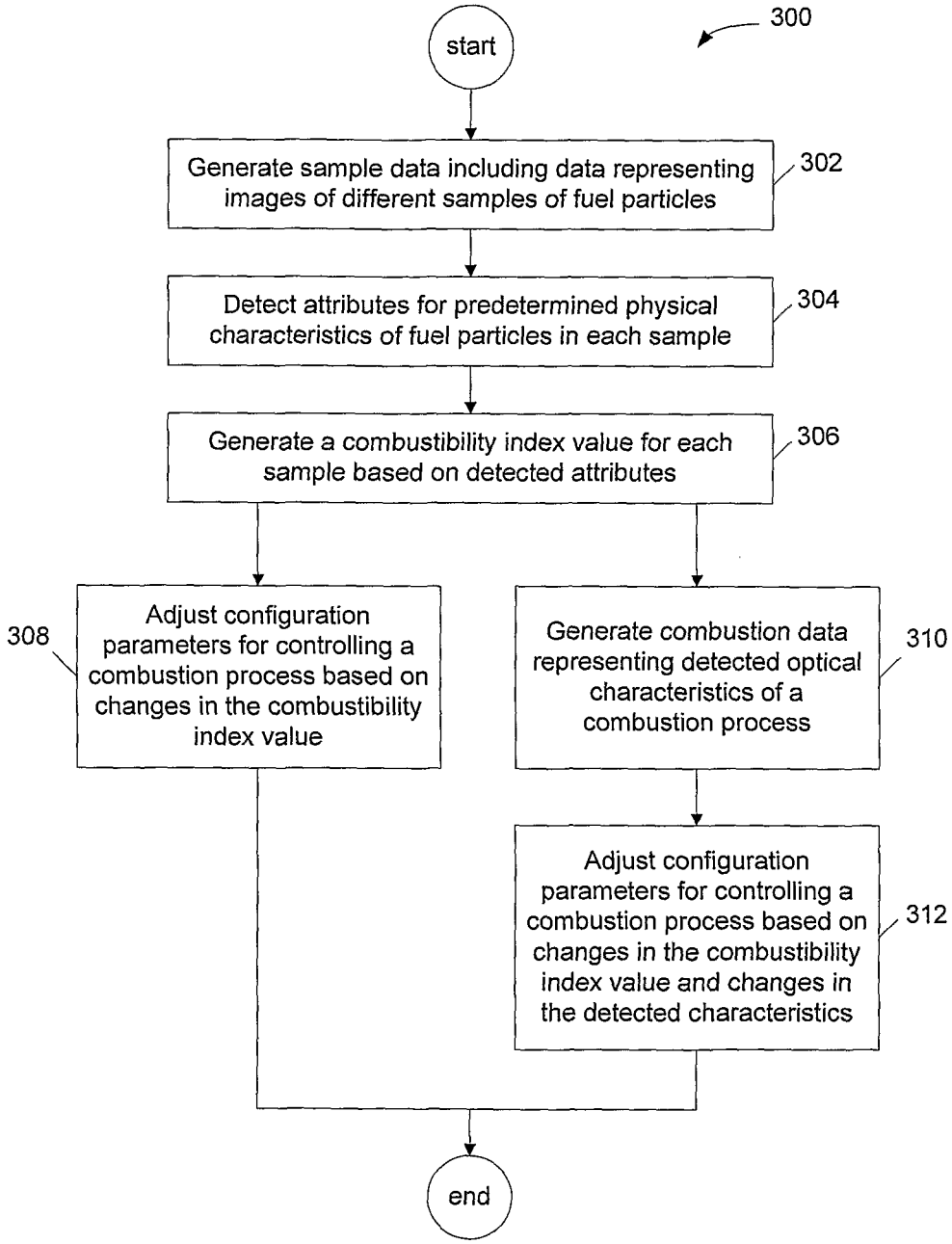
FIG. 3 is a flow diagram of a combustion control process.

FIG. 3 is a flow diagram of a combustion control process 300 performed by a processor acting under the control of the combustion control system 100. Process 300 begins at step 302 where the fuel analysis module 108 controls the processor to generate sample data including data representing images (or frames) of different samples of a fuel made up of solid particles. At step 304, the fuel analysis module 108 controls the processor to detect attributes corresponding to one or more predetermined physical characteristics of the particles of fuel in each sample. At step 306, the fuel analysis module 108 generates (based on the detected attributes for each sample) an index value for each sample representing a level of combustibility of the fuel in each sample.

In one configuration of the combustion control system 110, step 306 proceeds to step 308, where the combustion control module 112 analyses the changes in the index value for each sample over time and generates or adjusts one or more configuration parameters (e.g. an excess air feeding rate, fuel feeding rate and temperature) for controlling the combustion process.

In another configuration of the combustion control system 100, step 306 proceeds to step 310, where the combustion analysis module 110 generates combustion data including data representing images (or frames) of various dynamic optical characteristics of the combustion process within the combustion chamber 216 (e.g. flame dynamics, temperature dynamics and the presence of certain exhaust gases produced as a result of the combustion process). At step 312, based on the changes to any of these optical characteristics over time (and together with the changes in the index value over time), the combustion control module 112 determines the need for and level of adjustment to any of the control factors. Process 300 ends after steps 308 and 312, and is repeated again from step 302 to process the sample data and combustion data in respect of a different sample of the fuel.

In another representative embodiment, the first set of sensors 104 may include one or more sensors adapted for monitoring a physical condition of one or more mechanical components. For example, the sensors 104 may be adapted to monitor an extent of wear of a mechanical component in a grinder, mill, crusher 206 or pulveriser 210. The fuel analysis module 108 (or alternatively a separate analysis module of the system 100) may process a sequence of images (or frames) detected by the sensors 104 to determine whether the relevant mechanical component (e.g. by its shape or working characteristics, such as vibration) is within acceptable operating parameters. If the fuel analysis module 108 determines (based on the images) that the relevant mechanical component is damaged or is no longer operating effectively (e.g. due to mechanical wear, vibration or other damage), the fuel analysis module 108 may generate an alert signal, instruction or message to indicate that the relevant part requires maintenance or replacement.

In another representative embodiment, the first set of sensors 104 may include one or more special-purpose sensors adapted for monitoring a composition of the material collated at the bottom of the combustion chamber 216 (e.g. via opening 230). The special-purpose sensors may be configured to sample relevant parameters from the deposited material at regular time intervals (e.g. on a continuous basis). The relevant parameters may include a chemical composition of the material (such as the presence of carbon or other elements representing constituents of unburnt fuel). Sample data obtained by the special-purpose sensors are communicated to the fuel analysis module 108 (or alternatively a separate analysis module of the system 100) for analysis, which determines whether the combustion process within the combustion chamber 216 is resulting in any quantity of unburnt fuel (and possibly a rate at which the amount of unburnt fuel is being accumulated inside the combustion chamber, e.g. increasing or decreasing in volume over time). The fuel analysis module 108 may then make relevant adjustments to any of the factors described above for controlling the combustion process to enable a greater amount of fuel to undergo complete combustion.

In another representative embodiment, the second set of sensors 106 may include one or more sensors for detecting the presence of $CO_2$ produced by the combustion process inside the combustion chamber 216. The sensors provide data representing an amount of $CO_2$ produced (e.g. within each sampling timeframe) to the combustion analysis module 110. There are two ways for lowering the production of $CO_2$ in a combustion process using coal fuel. One is to make the combustion process more efficient, and the other is to mix wood into the coal fuel. The combustion analysis module 110 may respond to the sensors 106 detecting a presence of $CO_2$ by controlling the efficiency of the combustion process (as described above), or to control a fuel composition adjustment means (not shown in the FIGS.) to inject an amount of wood (e.g. fine wood chips or particles) into the coal fuel supplied to the primary and/or secondary grinders/burners 212 and 218. The amount of wood injected into the coal fuel is determined based on a predefined relationship (e.g. a proportional relationship) based on the amount of $CO_2$ detected by the sensors 106.

Any of the processes or methods described herein can be computer-implemented methods, wherein the described acts are performed by a computer or other computing device. Acts can be performed by execution of computer-executable instructions that cause a computer or other computing device (e.g. controller 102 or the like) to perform the described process or method. Execution can be accomplished by one or more processors of the computer or other computing device. Multiple computers or computing devices can cooperate to accomplish execution.

One or more computer-readable media can have (e.g. tangibly embody or have encoded thereon) computer-executable instructions causing a computer or other computing device to perform the described processes or methods. Computer-readable media can include any computer-readable storage media such as memory, removable storage media, magnetic media, optical media, and the like. Any related data structures used by the processes or methods described herein can also be stored (e.g. tangibly embodied on or encoded on) on one or more computer-readable media.

EXAMPLE

This section provides a detailed description of a specific exemplary embodiment of the combustion control system 100. The system 100 performs three stages of processing or analysis independently or concurrently. The first stage is establishing the combustibility indices of the pulverised coal and/or solid fuel. The second stage involves combustion flame dynamics analysis. The third stage involves emission reduction procedures as well as savings in the fuel quantity.

Stage 1—Combustibility Index

The first stage involves various image capture and processing steps and generating a combustibility index value based on an analysis of the material properties of the fuel. Table 1 summarises the key processes performed under the control of the system 100 in stage 1:

TABLE 1

| Process | Description |
|---|---|
| Step 1 - Series of cameras on conveyors, pre and post final milling, Image loggers and convertors | Image Acquisition from Video Cameras - Image including about 2000 grains, it takes 2-3 hours for manual delineation. By using a smart segmentation algorithm, it only takes 1-3 seconds to delineate all the grains. The difference of speeds is about 3000-10,000 times. |
| Step 2 - Coal lumps, Crushed coal, Pre pulverised coal, post pulverised coal at both pre and post final milling and fuel being charged into the boiler | Image Pre-processing - Increase the value of information - Preprocessing, Split & Merge, Merge small regions, Background split, Merge & Split on shape, Polygonal approximation, Classification of concavities, Split large clusters into simple clusters, and Supplementary cost functions for two or three touching particles. Image binarisation, Skeleton, Distance function, and Split based on skeleton histogram. |
| Step 3 - Image analysis of the fuel during all stages quantifying and qualifying coal quality, impurities and pulverised coal grain analysis | Image Segmentation - detection of objects - Image segmentation is important, is the hardest task and main problem in Computer vision. If target objects cannot be detected correctly, it is difficult to carry out object measurement, analysis and reconstruction. Since objects are complex, there is no universal segmentation algorithm. The main task and problem for an application is to develop segmentation algorithm. Size and form measurements - Shape and texture measurements, Object surface analysis, Object analysis on its moments. |
| Step 4 - Analysing shape, colour intensities, pulverised coal grain size and shape analysis, combustibility index analysis for energy content analysis | After the quantification and qualification of the fuel composition each grain of every identified element is given its specific unit weight and density. All the calculated individual elements characteristics are tabulated. Carbon quantity is analysed as a percentage of the total fuel composition and forms the basis for establishing its 'combustibility index' to further calculate the fuel energy content and oxygen demand for enhanced combustion. |

Coal (brown and black) is non-homogeneous and has numerous other elements/impurities bonded together. To convert the chemical bondage into heat energy, during combustion in any industrial boiler (mainly in power stations) the carbon content is obtained through laboratory analysis. The combustion control system 100 quantifies the coal composition online in real time and further analyses the crushed coal and powdered/pulverised coal to calculate its combustibility index for tabulation or designated by a serial number to establish its energy content. This provides a reliable and fully repeatable guide to the fuel's oxygen demand for maximum utilisation of its energy content, during all stages of combustion and oxidation. The higher the energy content is utilised the lesser the emission of $CO_2$. The following presentations explain the energy content of coal utilisation versus $CO_2$ reduction.

Every chemical element that is a part of the non-homogenous coal composition has its own specific colour and intensity as well as specific grain size and shape. A lump of coal contains a combination of any number of carbon particles and impurities. During grinding the lumps are crushed and powered to very fine grain sizes. Different elements have different densities and weights. These different elements form their own specific fine grains and have their specific colour, intensities, shape and size. By separating these individual grains using split and merge image processing techniques the composition of these main elements are tabulated. Wrong and inconsistent particle size distribution produces carbon monoxide resulting in wrong boiler balance, very poor combustion, pressure problems and eventually oxidises into $CO_2$. The system analyses the size and shape of the fuel online in real time, automatically analyses the fuel quality and impurities to determine its combustibility indices and the energy content.

The combustion control system 100 includes design and build of different types of cameras with specific settings and filters to capture different target data such as the fuel quality, burner performance, various blowers including soot blowers, combustion flame etc. The camera housing design built with 2 separate cooling systems and a nozzle prevents condensation of dust and suspended particles on the lens. The cameras can be used up to 1400° Celsius. The cameras are designed for pre-investigation to find the right position for mounting online cameras. They can be approximately 1.5 meters long to reach through all types of walls mounted on rails equipped with automatic temperature sensors. If the temperature is too high (temporary peaks or stoppage in the cooling systems), the camera automatically rolls out. The system 100 also includes monitoring systems designed for heat resistance, including a liquid and air cooled camera housing with a number of features to record true and reliable variation in the images and adjust features (such as light, contrast, volume, distribution, movement, dynamics etc.) being monitored, where variations in their behaviour/pattern provide the information required and co-related to the measured data from the fuel feeding, the combustion parameters and measurement readings, and the exhaust gas analysis and speed/volume.

The invention relates to online analysis of the quality of ground coal in a specially designed mill/grinder, changing the shape of the particles in a way that increases their ability to react in a controlled method and changes their behaviour in the combustion chamber.

The processing board is a PC-bus frame grabber card for most advanced computers and digital control systems (DCS) that control the operation of the boiler. The board can implement image acquisition, true/pseudo colour image display, graphic overlays, transparent manipulation, transformation, zoom, roam, real-time operation, change pixel aspect ratio and conduct many other important and relevant functions. The on-board frame memory includes multiport VRAM and is directly mapped with and has access to the memory space of the host computer. Each individual data bank contains a minimum of 8 layers of information (each pixel contains 8-bits). Table 2 describes the key functional elements of the system 100.

TABLE 2

| Function | Description |
|---|---|
| Basic operational processing features | File management - storage and retrieval of files<br>System control - set data bank, input, output etc<br>Look-Up-Table gives each figure a specific grey value<br>Data transmission - transform between online functions, storage disks and memory bank<br>Graphics and utilities |
| Image processing features | Key routines include: image access, image acquisition, image enhancement, image processing, morphological functions, binary image processing statistics, and dynamic and parametric analysis. |
| Image data file transformation features | All types of video formatted files and image transformation software. |
| Analysis features | Combustion flame dynamics analysis and control<br>Coal and pulverised coal quality analysis<br>Coal combustibility index analysis and generation<br>Coal and pulverised coal energy content analysis<br>Emission mitigation processes<br>$CO_2$ reduction processes<br>Combustion pressure and temperature gradients monitoring/analysis<br>Combustion turbulence and mixing monitoring/analysis<br>Flame intensity monitoring/analysis<br>Burner performance analysis<br>Monitoring and analysis of different types of gases emitting by combustion (including the volume, intensity, pressure and temperature of a particular gas). |

Look up table: The grey level values are shown through a LUT.

Image input: The image input is by an industrial high resolution video camera and its housing has 2 separate cooling systems and a nozzle to prevent condensation of dust and suspended particles on the lens. The images are processed and the size/resolution are automatically adjusted to suit their individual specific locations with auto scaling for accurate distance and quantity measurements.

Image pre-processing: Numerous main and sub-routines clean enhance and retrieve images. Depending on the grey-level functions and contour filters borders of each pixel or colour concentration gradients of light intensities are created. All images are subjected to a series of filtering to eliminate noise by functional analysis including smoothening, median, local, averaging, edge preserving, inverse, Wiener, least square filters and many more with the software automatically selecting the best combination of the sequence of filtering.

Enhancement: Images are enhanced by selecting and comparing grey-scale transformations such as linear, non-linear, histogram, specific filtering, sharpening and contour enhancement filters.

Segmentation: Two aspects of segmentation are detection of edge and region divisions and are combined for complex images. Edge detection includes differential calculus and Kirsch and Laplace transformations. Region segmentation is judgment criteria such as Radmogorow-Smirnov, Smoothed difference, Phagocyte and weakness. For non-binary images, these methods are improved by incorporating Recursive thresh-holding, dynamic thresholding (adaptive thresh-holding), Border following and Texture analysis subroutines.

Binary picture processing: The light grey level represents objects whereas the black grey level represents background (including edges, small regions etc.). The sub-routines are established for erosion-dilation, image cleaning, opening, closing and region fill.

Shape analysis: Merging, splitting and correction of shapes perform this. This is highly creative and includes "artificial intelligence" based on characters and properties of material of images. Parameters and information from real applications are used to pre-set limits and controls, and statistical methods are applied.

Size/shape/function measurement and presentation: Area distribution or light distribution is chosen for calculations, and for presentation different simulation routines are adapted, such as Monte Carlo (for presentation of weight distribution based on area calculations), or other routines for rock size presentation, size class histograms and RRS-curves.

Data output: Data from result files are output as 4-20 mA or 0-10 V analog signals, and are fed into existing process control systems.

The system 100 automatically acquires series of images (in excess of 50 to 100 per second) from the online video cameras at periodic sequences, performs a number of filtering and enhancing routines, abstracts regions and borders for qualitative and quantitative analysis, carries out numerous segmentation sub-routines and constructs the flame in binary format. A series of shape analysis are automatically carried out for statistics and dynamic parametric calculations to isolate fuel quality, status of combustion and process information such as temperature distribution and pressure distribution. The analysis is further enhanced by Multivariate Data Modelling techniques.

Several cameras monitor the entire combustion process inside the boiler and are correlated to the changes in the boiler settings. Special hardware filters are used on the cameras to enhance information that is partly hidden by burning gas and/or intense light to enhance the flames to isolate the burner's performance. The system 100 processes all video files and includes several special designed algorithms:

Image grabbing and scaling are an automatic function: During pre-processing images are enhanced; a noise reduction function activated and converts the video film into a number of wavelengths for advanced further analysis.

Translating image information into conventional 4-20 mA signals: This allows any type of DCS to use the image information.

Recording and analysing the images of the combustion in the boiler: It is possible to follow the movements, see the changes in the shape of the flame, isolate and follow the "dark" clouds that represent un-burnt (or mis-burnt) fuel, gasses being formed. Monitors temperatures and temperature differences. Monitor slag build up on superchargers.

Real-time input from the cameras: Such image data provides extremely valuable information. The quality of the information can vary depending on the type of analysis, but monitors the variations in a repeatable way and is the key. With this information and together with readings from the DCS (plant's Digital Control System); builds a model. It could be a 3D-model for visualization (such a model is not for the settings control). The algorithms send signals for settings adjustment and combustion enhancement and control. Such algorithms analyse "combustibility index of the fuel" (cameras monitoring the size distribution online, or a quick-sampling system with image analysis, if not online but with fast feedback) and the "combustion dynamics" (turbulence, rotation and movement of the burning gas) and most importantly the shape of the flame that has the required information.

Flame position detection: This is related to the measurements of bed length/fuel quantity, flame distribution and temperature distribution. Based on colour and light intensity similarity and strength of edges of image, the algorithm uses colour information to merge similar zones in an image, then combines edge information to delineate the boundaries of flames, and finally detects front or centre positions of flames.

Burning material detection: This involves analysing images for material falling stream, and detecting the boundary of burning material pile. The system uses prior knowledge such as general position of burning material pile, and burner information to use both canny edge detection and merge & split technology to obtain basic material zone, then carries out linear edge detection line by line from top to bottom to determine the top most position of burning material pile and traces its boundary.

Bed length detection: This involves measuring the distance between burner door and flames. After flame zone detection based on the above procedure, the back boundaries of flames are traced, as the boundaries are not straight lines, the system creates a line based on calibrated data and flame detection results. This line is used for measuring the distance between flames and burner door. Since the distance is not a flat distance, different parts have different scaling factors; and the system calibrates part to part and obtains the true distance.

The technology provides extensive analysis for stage wise reduction in excess air to save substantial amounts of fuel or alternately increases higher heat/steam production for the same amount of fuel.

Stage 2—Flame Dynamics Analysis

The second stage involves analysis of various characteristics of the flame, including by-products produced by the flame. Table 3 summarises the key processes performed under the control of the system 100 in stage 2:

TABLE 3

| Process | Description |
|---|---|
| Step 1 - Series of cameras on flame, burners, superchargers, exchangers, soot and exhaust fans and boiler internals | Automatically acquires series of images (in excess of 50 to 100 per second) from the online video cameras, performs number of filtering and enhancing routines, abstracts regions and borders, carries out numerous segmentation sub-routines and constructs the flame in binary format. A series of shape analysis are automatically carried out for statistics and dynamic parametric calculations to isolate fuel quality, status of combustion and process information such as temperature distribution and pressure distribution. The analysis is further enhanced by Multivariate Data Modelling techniques. |
| Step 2 - Flame dynamics such as colour intensities, colour variations, flame shape, tracking oxygen cell, etc | Flame position detection is related to the measurements of bed length/fuel quantity, flame distribution and temperature distribution. Based on colour and light intensity similarity and strength of edges of image, the algorithm uses colour information to merge similar zones in an image, then combines edge information to delineate the boundaries of flames, finally detects front or centre positions of flames. |
| Step 3 - Image analysis of the flame temperature differences, wavelengths, combustion pressure differences for quality and quantity analysis | This involves the combustion control system 100 recording (e.g. in real time) numerous parameters of the combustion such as fuel bed (amount of fuel present), temperature gradients, pressure gradients, turbulence (mixing) and excess air. Good combustion depends on $H_20$ and $CO_2$ and bad combustion produces different poisonous gases like Nitrogen/sulphur complexes, and CO depending on type of fuel and type of combustion technology (furnace, boiler etc). |
| Step 4 - Combustion enhancement, optimisation, analysis of types of gasses, intensities, volumes and pressures for quantity and quality analysis | Optimised combustion should balance CO (too little oxygen) and CO2 (too "much" oxygen and too little water). This reduces the amount of $CO_2$ per kg of fuel (minimises the amount of oxygen from excess air. The system 100 adjusts operating parameters within the permissible design and safe operating levels of the plant. All such parametric changes shall be strictly carried out only by the plant's authorised engineers/technicians. This helps mitigate risk to the plant, and ensure that there will be minimal reduction in plant performance and output during the period of implementation. The system 100 can be customised. |

Instead of the human eye, system 100 uses a camera that provides high speed and high accuracy non-touch measurement, and analyses the information required to control combustion dynamics with low excess oxygen a factor that is vital for minimizing emission. In order to comprehensively control combustion it is extremely important to quantify the quality of the fuel and its combustibility indices and its energy content. The system 100 automatically analyses the fuel's energy content and controls all stages of the combustion to enhance the fuel's chemical bondage conversion to heat energy at the same time as controlling the emission of gasses for the $CO_2$ and other gas reduction procedures. "Blow-outs", "Cold sections", "Dynamic turbulence" and "Convection" are monitored and optimised for effective combustion and also emission reduction. This is a phenomenon of dynamics and shape in vertical movement and circulatory, and "off-lets" (suction) temporary explosions and implosions. The optimal combustion is a combination of flame shape, oxygen positioning, semi-turbulent, but controlled dynamics—vertically controlled by the exhaust fan, (but circular and pressure distribution is very individual) and often some secondary air in the right place that produces the post-oxidation—in old burners this is often produced by a "leak" that sucks air half way up and—even such "leaks" can be seen with the combustion camera of the present invention when mounted to monitor secondary combustion.

A unique feature of the system 100 is that it records, in real time and online, numerous parameters of the combustion such as fuel bed (amount of fuel present), temperature gradients, pressure gradients, turbulence (mixing) and excess air. Good combustion depends on H2O and CO2 and bad combustion produces different poisonous gases like Nitrogen/sulphur complexes, and CO depending on type of fuel and type of combustion technology (furnace, boiler etc). Optimised combustion must balance CO (too little oxygen) and $CO_2$ (too "much" oxygen and too little water).

The key algorithms used by the system 100 include:

Flame position detection: This involves measuring the bed length/fuel quantity, flame distribution and temperature distribution. Based on colour and light intensity similarity and strength of edges of image, the algorithm uses colour information to merge similar zones in an image, then combines edge information to delineate the boundaries of flames, and finally detects front or centre positions of flames and measurement of flame distribution based on the emitted electromagnetic waves (SPECTRAS). Measurements are taken at hundreds of thousands of points—50 or 100 times per second. Based on colour and light intensity similarity and strength of edges of image, the system 100 uses colour information to merge similar zones in an image, then combines edge information to delineate the boundaries of flames, and finally detects the front or centre positions of flames.

Burning material detection: This involves analysing images to determine material falling stream, detects the boundary of burning material pile, which is complicated. The system 100 uses information such as general position of burning material pile and burner information to use both canny edge detection and merge & split technology to obtain basic material zone, then carries out linear edge detection line by line from top to bottom to establish top most position of burning material pile, and finally traces the boundary.

Bed length detection: This is mainly for measuring the distance between burner door and flames. After flame zone detection the back boundaries of flames are traced, but as the boundaries are not straight lines, the system creates a line based on calibrated data and flame detection results. This line measures the distance between the flames and burner door. Since the distance is not a flat distance, different portions of the image require different scaling factors and the system calibrates from part to part to obtain the final true distance.

Important for optimising combustion is the positioning of the excess air/oxygen in the required location of the combustion zone, meaning where it is required and not how much is available. Excess air in the wrong location does not contribute to combustion; it only cools the boiler (less steam) and dilutes the emissions (good for monitoring but bad for energy production). Image analyses provide reliable advice about where the excess air is required based on the dynamics of combustion. The key parameters used by the system 100 include:

The quantity of fuel being burnt
The height and volume of the combustion chamber
The fuel's quality and chemical composition
Conditions before purification
Temperature distribution (GASBLANDNINGEN)
The average temperature in the combustion chamber
The fuel's energy content The system 100 automatically measures and analyses soot and slag build up on the super-heaters that cause loss of suction. The system 100 can also recirculate exhaust gas to cool the super-heaters as well as minimise $O_2$ to enhance dynamics if secondary air registers are available. The system 100 can also analyse (e.g. after the final mill) the size distribution of fuel particles, which may be monitored continuously or sampled numerous times under different operating and environmental conditions.

Stage 3—Emission Reduction and Fuel Savings

The third stage involves the system making various adjustments to parameters controlling the fuel and/or process of combustion to reduce emissions and to reduce fuel consumption. Table 4 summarises the key processes performed under the control of the system 100 in stage 3:

TABLE 4

| Process | Description |
|---|---|
| Step 1 - Series of cameras on flame, burners, superchargers, exchangers, soot and exhaust fans and boiler internals | Automatically acquires series of images (in excess of 50 to 100 per second) from the cameras, performs number of filtering and enhancing routines, abstracts regions and borders, carries out numerous segmentation subroutines and constructs the flame in binary format. A series of shape analyses are carried out for statistics and dynamic parametric calculations to isolate fuel quality, status of combustion and process information such as temperature distribution and pressure distribution. The analysis is enhanced by Multivariate Data Modelling techniques. |
| Step 2 - Analysis of the flame dynamics, 3-D flame ball geometric generation to analyse the flame dynamics visualisation | Software includes principles of Material Science for continuous online real time quality analysis of the fuel. The system 100 implements principles of physics and chemistry of the combustion in real time (pressure and temperature gradients, turbulence, flame intensity, all stages of combustion, gas volumes, gas pressures, gas temperatures etc just to name a few important features). The system's 100 software implements numerous features for principles of mechanics for online combustion dynamics control settings. The system's 100 software implements principles of chemistry based not |

TABLE 4-continued

| Process | Description |
|---|---|
| | just on constant oxygen supply but also the chemical composition of the fuel, oxygen demand and actual dynamics and relevant parametric analysis during all the stages of combustion. |
| Step 3 - Tracking the intensities of combustion dynamics, time to burn, flame and gas turbulence, temperature and pressure gradients | The invention includes a series of shape analysis, statistics and calculation programs to calculate the positioning, temperatures, temperature distribution and shape parameters into a data file and transformed into analog output signals for continuous information about changes in the combustion. The output signals trigger an alarm, alert a relay or are entered into the process control systems for automatic adjustment of the operating and or production parameters. |
| Step 4 - Adjusting combustion dynamic parameters for reduction of gas emission, and fuel savings analysis | There generally are several burners at different positions and different heights - this implies that the setting of each burner should be individual, in order to create a dynamic movement of the oxidizing "cell" that permits maximal combustion/oxidation. The system 100 automatically registers and analyses the optimal settings of each set of burners to analyse the efficiencies of all the burners to set up a scaled up individual status of their performance to enhance combustion for increased energy production and emission reduction. |

The relationship between the important parameters and the combustion are:

Time: how long is the fuel present in the combustion chamber before it is totally burnt. The time for the entire combustion is calculated from the video films from a number of cameras tracing the path of the fuel charge, pre, during and post combustion stages.

Temperature: at what minimum temperature is the fuel totally burnt. Images are analysed to separate numerous temperature zones based on the colours and their intensities. The systems analyses isolate temperatures zones equal to or in excess of 262,000 temperature gauges.

Turbulence: dynamics of oxygen and air supply for steady flame for good combustion. Combustion involves a complex set of complicated chemical processes depending on the fuel's chemical composition.

The system 100 analyses the images to isolate each pressure zone and their intensities to calculate the movement of the oxygen cell, fuel combustion and emitted gas intensities. During combustion the fuel undergoes the following phases:

Preheating/heating: The fuel is prepared or undergoes drying and preheating and is affected by how the burner trims work. This is also done by re-circulating the smoke even if the burner trims are inadequate. The systems 100 tracks and traces fuel decomposition and combustion. The system 100 addresses decomposition of minerals in the fuel during combustion as this is an important process that has to be understood and quantified throughout the entire combustion process and period. Physically the different stages of decomposition process overlap each other and one cannot practically or theoretically truly establish the relationship between the different stages due to the inconsistency in the fuel composition unless these are quantified online in real time.

Formation of Gasses: The solid fuel breaks down to form flammable gases in different stages which overlap, where the most volatile mineral gas composition commences. The system 100 tracks and traces fuel decomposition at all stages of combustion to calculate and isolate the emission gas pressures, temperatures, volumes and intensities. The right trim of a burner has two primary requirements which are that the pressure must be maintained constant in order to respond to changes in load and energy demands and to set excess oxygen at 3.5% and maintain constantly during production. When these basic demands are met, burners run safe, economically and generate minimum of emission. It is not difficult to decrease NOx emissions to approx. 60 mg/MJ, but is difficult with conventional systems to maintain constant production. Primary air supply tends to be secondary (at low loads), disrupting conventional control systems. This system 100 interfaces with existing control systems, monitors changes in energy content of fuel and controls air feed, all without operators manual corrections. The system tracks and traces fuel decomposition and combustion. The system 100 addresses decomposition of minerals in the fuel during combustion as this is an important process that has to be understood and quantified throughout the entire combustion process and period. Physically the different stages of decomposition process overlap each other and one cannot practically or theoretically truly establish the relationship between the different stages due to the inconsistency in the fuel composition unless these are quantified online in real time.

Combustion chemical process

The system 100 may be adapted to provide other feature including:

Multivariate Data Analysis—Dynamic Operational Signature Extraction Techniques: Operational parameters and spectral analysis is vastly enhanced by MVDA in segregating and quantifying of individual or combinations of discrepancies that cause changes to the performance datum resulting in inadequate combustion and formation of poisonous gasses.

Dynamic coordinate system with floating origins: Each discrepancy has its one specific spectral co-ordinate geometry. Changing dynamic operational signature results in the co-ordinates of the spectra constantly changing their origin. The origin will be continuously floating and can never be at any fixed position. Therefore recording of events that are operational, environmental or external parameter influences can be virtually impossible to identify and quantify. The system 100 implements an intelligent spectral extraction technique to enable accurate recording of all discrepancies and origins, with auto triggering for advanced data modelling and parametric analysis.

Event governing variables isolation and analysis: Every event, discrepancy and fault disturbance is governed by a number of follow on variables. The system 100 isolates and quantifies each of the variables referenced to its origin within the dynamic co-ordinates to analyse the cumulative severity of the event. Analysis of numerous operating variables provides reliable solutions for parametric predictions. The system includes intelligent data extraction algorithms specifically designed intelligent systems for comprehensive performance control and optimisation routines.

Mechanics and automated systems: The system can generate a 3D-model of the combustion flame ball for visualisation but not for the control. Special algorithms based on analysed and modelled information are used for control. The automated control system (PLC) can be stand alone or can interact with the plant control systems (DCS). This provides extensive data and information on the performance of each individual burner. For boilers with more than one burner standard DCS cannot work with each individual burner and only works with the cumulative result of all burners together. Most plant controls systems record nearly 2000 different parameters. The system 100 interacts with the parametric analysis to control, fuel supply, fuel quality, flame intensities, oxygen supply, excess air supply, soot blowers, exhaust fans, regulates burner performances and controls reduction of emission of gases such as CO, $CO_2$, $NO_x$, $SO_x$, Hg etc and fuel savings.

Key Advantages of the Combustion Control System

The key advantages of the combustion control system 100 can include one or more of the following:

The ability to improve combustion dynamics, reduce fuel usage, and reduce emissions of $CO_2$/other toxic gasses, including other related plant enhancement benefits both technical and financial (using image analysis and interactive process control software).

The ability to record and measure all intermittent and continuous variations in fuel quality and quantity, monitor primary and secondary combustion, and analyse the combustion dynamics including temperature gradients. With a specially developed "looking glass" the system 100 can automatically reflect all unwanted wavelengths retaining detailed data of the dynamics that controls the emission. This leads to further analysis and predictions of numerous dynamic operating parameters that assist in optimizing fuel usage, air input, gas dynamics and temperatures.

The ability to provide environmental benefits, and assists in forming 'safe cycle' of solid fuel combustion (not adding emissions into atmosphere, but natural process of regenerating cycle). This system's 100 combustion optimization software interfaces with all standard PLC systems for automatic process control.

The ability to use video image analysis to determine and continuously measure the quality changes in ground and pulverized coal fuel, by correlating to its size distribution.

The ability to use video image analysis to determine and continuously measure the combustibility" of ground/pulverized coal correlated to its size distribution and particle shape.

The ability to measure or detect variations in combustion performance.

The ability to provide software and algorithms for combustion flame shape analysis that measures the combustion dynamics, i.e. the interchanges & representation of primary and secondary oxidation. The system 100 includes software and algorithms for temperature measurements based on correlation with wavelength information and combined with shape analysis to determine the overall oxidation surface and the formation of CO, $CO_2$, $NO_x$ and other poisonous gasses.

The ability to use image analysis to measure the volume and the composition of redistributed exhaust gas into the combustion chamber and its effect on optimizing the oxidation while mitigating the formation of CO, $CO_2$, $NO_X$ and other unwanted gasses The ability to use image analysis to measure the appearance, volume and position/distribution/shape of CO2 formed in the combustion chamber (primary, secondary and tertiary combustion) and over-heating.

The ability to analyse the quality of ground coal (also valid for all particles, including cement etc.) in a specially designed mill/grinder, changing the shape of the particles in a way that increases their ability to react in a controlled method and changes their behaviour in the combustion chamber.

The ability for continuous measurement of the volume weight of a particle material passing on a conveyor belt mounted on a scale, with image analysis measurements in two or three directions measuring size distribution variations and surface grid and height changes.

The use of principles of material science for continuous online real time quality analysis of the fuel. The system's 100 software implements principles of physics and chemistry of the combustion in real time (pressure and temperature gradients, turbulence, flame intensity, all stages of combustion, gas volumes, gas pressures, gas temperatures etc just to name a few important features). The system's 100 software implements principles of mechanics for online combustion dynamics control settings. The system's software implements principles of chemistry based not just on constant oxygen supply but also the chemical composition of the fuel, oxygen demand and actual dynamics and relevant parametric analysis during all the stages of combustion.

The ability to address important scientific features of combustion, establish online in real time the 'Energy content' of fuel and its $CO_2$ emission content per kg/ton of fuel to enhance energy content maximum utilization through controlled and improved combustion and emission mitigation. The system 100 is also able to maximise the energy content of fuel resulting in savings in fuel quantity and emission reduction.

The ability to analyse fuel quality to determine the optimized combustion dynamics settings and with the burners at differing heights automatically analyses the combustion status in both quantity and quality through to the completion of the combustion process in real time and continuous online. Oxygen is regulated based on the measured and analysed pre, during and post oxidation stages of combustion, continuous online in real time and is fully automated.

The ability to maximise the utilization of the energy content of coal to increase the energy production. With better utilization of the energy content of coal we reduce the amount of coal used compared to the equivalent standard coal usage per MW power output. The system 100 further control emission to reduce $CO_2$ produced per kg or ton of coal burnt. Indirect advantages include plant combustion automation, safety, reduced boiler maintenance etc.

The ability to monitor flame shape and flame dynamics, and its variations in real time (including temperature gradients, oxidizing performance and "use of oxygen put into the burner" (sometimes the content of oxygen should be decreased, and sometimes the pressure/flow of air/oxygen should be minimized).

The ability to increase efficiency and increase of energy production.

The ability to reduce $NO_x$ and CO emissions.

Increased safety.

Increased power production capacity.

Longer life of the burners by lowering excess flame.

Addition of Ammonia and Urea—decreased or totally eliminated

The ability for providing ash regeneration—Technology is for environmental considerations, and assists in forming safe cycle for solid fuel combustion (not adding emissions into atmosphere, but natural process of regenerating cycle).

The ability to continuously monitor the flame with shape analysis techniques to give output signals representing different shape and function. These signals (analog 4-20 mA) are used for controlling the parameters of combustion (fuel, pressure, distribution, temperature, turbulence, time to burn, software settings etc.)

The ability to control the composition of fuel by controlling the inclusion of an additive. For example, the system 100 can use predetermined equations and tables to calculate an amount of bio fuel to blend in with coal to improve its combustion efficiency, and thus reduce the production of $CO_2$ and other poisonous gasses emissions for an equivalent quantity of standard fuel. Bio fuel can be carbon neutral.

Modifications and improvements to the invention will be readily apparent to those skilled in the art. Such modifications and improvements are intended to be within the scope of this invention.

The word 'comprising' and forms of the word 'comprising' as used in this description and in the claims does not limit the invention claimed to exclude any variants or additions.

In this specification, including the background section, where a document, act or item of knowledge is referred to or discussed, this reference or discussion is not an admission that the document, act or item of knowledge or any combination thereof was at the priority date, publicly available, known to the public, part of common general knowledge, or known to be relevant to an attempt to solve any problem with which this specification is concerned.

The invention claimed is:

1. A combustion control system, including:

a first set of sensors for generating sample data including data representing a sequence of detected images of different samples of a fuel made up of solid particles wherein the first set of sensors are positioned within visible range of samples of the fuel entering a combustion system;

a fuel analysis module for controlling a processor of a computing device to: (i) determine attributes for one or more predetermined physical characteristics of the particles in each said sample based on the sample data, and (ii) generate a combustibility index value for each said sample based on said attributes, said combustibility index value representing a rate of combustibility and an energy content of the particles in each said sample; and a combustion control module for controlling a processor of a computing device to adjust one or more parameters for controlling a combustion process based on changes to said combustibility index value over time.

2. A system as claimed in claim 1, wherein said physical characteristics include one or more of the following characteristics of at least one of said particles in a said sample:

i) a size of said particle;

ii) a shape of said particle;

iii) one or more wavelengths of light reflected by said particle;

iv) an intensity of one or more wavelengths of light reflected by said particle; and v) a texture of a part of a surface of said particle.

3. A system as claimed in claim 1, wherein said first set of sensors includes a weight sensor, and said physical characteristics include a weight of at least some of said particles in a said sample.

4. A system as claimed in claim 1, wherein said combustion control module adjusts a value corresponding to one or more of the following said parameters (i) to (v) to control production of one or more products of combustion relative to a level of said products in a complete combustion, said products including CO, $CO_2$, $NO_X$, $SO_X$, soot and slag:

i) a fuel feeding rate;

ii) a primary air feeding rate;

iii) a secondary air feeding rate;

iv) a rotational speed of a fan for extracting exhaust gases from a combustion chamber; and v) a level of exhaust gas recirculation within a combustion chamber.

5. A system as claimed in claim 1, including:

a second set of sensors for generating combustion data including data representing a sequence of detected images of a combustion process;

a combustion analysis module for controlling a processor of a computing device to determine attributes for one or more predetermined characteristics of a product resulting from said combustion process based on said combustion data; and wherein said combustion control module being adapted to adjust one or more of said parameters based on changes to said index value over time and changes to said detected attributes for said predetermined characteristics over time.

6. A system as claimed in claim 5, wherein said product includes a flame resulting from said combustion process, and said predetermined characteristics of said flame include one or more of the following:

i) a shape of said flame;

ii) a size of said flame;

iii) a position of said flame relative to a part of said combustion chamber;

iv) one or more wavelengths of radiation produced by said flame; and v) an intensity of one or more wavelengths of radiation produced by said flame.

7. A system as claimed in claim 5, wherein said product includes heat resulting from said combustion process, and said predetermined characteristics of said heat includes a temperature gradient within a predetermined space inside said combustion chamber.

8. A system as claimed in claim 5, wherein said product includes at least one of (a) CO, (b) $CO_2$, (c) $NO_X$, (d) $SO_X$, (e) soot, and (f) slag, and said predetermined characteristics of said product includes one or more of:

i) an intensity of one or more wavelengths of radiation in said combustion chamber for indicating a presence of said product; and ii) an intensity of one or more wavelengths of radiation in said combustion chamber for indicating an absence of said product.

9. A system as claimed in claim 1, wherein said sensors include an image sensor adapted for capturing said sequence of images and generating video data representing said sequence of images.

10. A system as claimed in claim 5, wherein said second set of sensors are adapted to include an optical filter for detecting the presence or absence of one or more specific wavelengths of radiation.

11. A system as claimed in claim in claim 5, wherein said second set of sensors are adapted for use inside a combustion chamber, said second set of sensors being adapted to include a heat sensor and actuating means, wherein when said heat sensor detects a temperature level inside said combustion chamber reaching above a predefined temperature threshold, said actuating means is activated to retract said second set of sensors outside of said combustion chamber.

12. A combustion control process including the following sequence of actions:

providing a first set of sensors wherein the first set of sensors are positioned within visible range of samples of a fuel entering a combustion system; wherein the first set of sensors generate sample data including data representing a sequence of detected images of different samples of the fuel made up of solid particles;

determining attributes for one or more predetermined physical characteristics of the particles in each said sample based on the sample data;

generating a combustibility index value for each said sample based on said attributes, said combustibility index value representing a rate of combustibility and an energy content of the particles in each said sample;

adjusting one or more parameters for controlling a combustion process based on changes to said combustibility index value over time.

13. A process as claimed in claim 12, wherein said physical characteristics include one or more of the following characteristics of at least one of said particles in a said sample:

i) a size of said particle;

ii) a shape of said particle;

iii) one or more wavelengths of light reflected by said particle;

iv) an intensity of one or more wavelengths of light reflected by said particle;

v) a texture of a part of a surface of said particle; and vi) a weight of at least some of said particles in a said sample.

14. A process as claimed in claim 12, wherein said combustion control module adjusts a value corresponding to one or more of the following said parameters (i) to (v) to control production of one or more products of combustion relative to a level of said products in a complete combustion, said products including CO, $CO_2$, $NO_X$, $SO_X$, soot and slag:

i) a fuel feeding rate;

ii) a primary air feeding rate;

iii) a secondary air feeding rate;

iv) a rotational speed of a fan for extracting exhaust gases from a combustion chamber; and v) a level of exhaust gas recirculation within a combustion chamber.

15. A process as claimed in claim 12, including the following sequence of actions:

generating combustion data including data representing a sequence of detected images of a combustion process;

determining attributes for one or more predetermined characteristics of a product resulting from said combustion process based on said combustion data;

adjusting one or more of said parameters based on changes to said index value over time and changes to said detected attributes for said predetermined characteristics over time.

16. A process as claimed in claim 15, wherein said product includes a flame resulting from said combustion process, and said predetermined characteristics of said flame include one or more of the following:

i) a shape of said flame;

ii) a size of said flame;

iii) a position of said flame relative to a part of said combustion chamber;

iv) one or more wavelengths of radiation produced by said flame; and v) an intensity of one or more wavelengths of radiation produced by said flame.

17. A process as claimed in claim 15, wherein said product includes heat resulting from said combustion process, and said predetermined characteristics of said heat includes a temperature gradient within a predetermined space inside said combustion chamber.

18. A process as claimed in claim 15, wherein said product includes at least one of (a) CO, (b) $CO_2$, (c) $NO_X$, (d) $SO_X$, (e) soot, and (f) slag, and said predetermined characteristics of said product includes one or more of:

i) an intensity of one or more wavelengths of radiation in said combustion chamber for indicating a presence of said product; and ii) an intensity of one or more wavelengths of radiation in said combustion chamber for indicating an absence of said product.

19. A system as claimed in claim 5, wherein said sensors include an image sensor adapted for capturing said sequence of images and generating video data representing said sequence of images.

* * * * *

UNITED STATES PATENT AND TRADEMARK OFFICE

CERTIFICATE OF CORRECTION

PATENT NO. : 8,714,970 B2
APPLICATION NO. : 13/497117
DATED : May 6, 2014
INVENTOR(S) : Dahlhielm et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 16 days.

Signed and Sealed this
Twenty-ninth Day of September, 2015

Michelle K. Lee

Michelle K. Lee
*Director of the United States Patent and Trademark Office*